United States Patent [19]

Lee et al.

[11] 4,424,651

[45] Jan. 10, 1984

[54] MULTI-EXIT PARKING GARAGE

[76] Inventors: Hyong Lee, 383-253, Sutek-ri, Kuri-ep, Namyangju-gun, Kyonggi-do; Chul H. Kim, 127-29, Hongji-dong, Chongro-ku, Seoul, both of Rep. of Korea

[21] Appl. No.: 368,586

[22] Filed: Apr. 15, 1982

[30] Foreign Application Priority Data

Apr. 17, 1981 [KR] Rep. of Korea ..... 2756

[51] Int. Cl.[3] ..... E01F 9/00

[52] U.S. Cl. ..... 52/175

[58] Field of Search ..... 52/175, 176

[56] References Cited

U.S. PATENT DOCUMENTS

| | | | |
|---|---|---|---|
| 2,560,393 | 7/1951 | Mauriell | 52/175 |
| 2,825,938 | 3/1958 | Ferreira | 52/175 |
| 2,908,946 | 10/1959 | Sullivan | 52/175 |
| 2,961,718 | 11/1960 | Berz | 52/175 |
| 3,105,999 | 8/1963 | Piazolo | 52/176 |
| 3,266,205 | 8/1966 | Khoury | 52/175 |

FOREIGN PATENT DOCUMENTS

| | | | |
|---|---|---|---|
| 1103949 | 11/1955 | France | 52/175 |
| 365525 | 11/1962 | Switzerland | 52/175 |

*Primary Examiner*—John E. Murtagh
*Assistant Examiner*—Kathryn Ford
*Attorney, Agent, or Firm*—Armstrong, Nikaido, Marmelstein & Kubovcik

[57] ABSTRACT

A parking garage building comprising a plurality of stories with each story having parking spaces marked thereon. The plurality of stories are divided into blocks of several stories each. An access ramp is connected to each story. A plurality of egress ramps are attached to the building with each egress ramp ascending from ground to one of the blocks without access to any lower block. Each egress ramp has access to each story of its associated block. The ramps can be arranged in helical fashion on the outside of the building.

2 Claims, 4 Drawing Figures

MULTI-EXIT PARKING GARAGE

BACKGROUND OF THE INVENTION

The present invention relates to a multi-exit parking garage with increased roadway function and a maximum parking capacity.

Parking garages are generally classified into two kinds:

1. One in which motor vehicles can be put in and taken out of one location of the garage by a mobile carrying device; and 2. the other in which motor vehicles can be driven into a certain location of the garage and parked there.

The parking invention is limited to the latter of the parking methods. The availability of motor vehicles to meet the traffic demand, the availability of sufficient road spaces to cater to vehicular flow demand, and making the maximum parking space available to meet the increasing use of motor vehicles are the three major elements considered vital to urban development and urban functioning.

Ever-increasing vehicles in cities produce a corresponding need for parking spaces and therefore, the parking problem has emerged as an integral program of urban planning and become a project of priority for public facility investment in urban planning.

This concept of parking is becoming established in view of functional consideration of large cities throughout the world in recent days and parking spaces is considered as the central task in urban functions.

The composition of road networks in urban planning projects depends largely on the location and demand of parking areas. Lack of parking spaces in cities creates road-side parking which induces the deterioration of road function and traffic congestion, with the final result of slowing down vehicle output against the increasing demand of motor vehicles.

Motor vehicle output and parking plans are closely interrelated in urban planning and, today, there is a tendency that the vehicle output plan and road plan (urban development) appears to be subject to practical parking capacity.

Generally, a parking space in an urban area is understood to be necessary to be available within a distance of more or less than a 300 meter radius. Such an acceptance of ordinary parking distance is a result derived from the experimental data of the walking distance limit after parking.

Urban planners and parking experts ALIKE admit from their experience and data that a single parking building cannot afford to accommodate more than 500 to 600 vehicles in practice because people will decline to park their cars at stories above a 5th or 6th story. Thus, high-rise floors above five or six stories fail to effectively serve as parking areas.

This is because, as the existing high-rise parking garages were provided respectively with a single-lane up and down passage, those vehicles to be parked in and driven out from each story of the high-rise parking building cause traffic congestion within the parking garage by necessitating quardruple crossing for quardruple passages.

Lately, the high density pattern of urban cities, parking demand within the walking distance limit exceeded by several times the parking capacity and, as a consequence, parking areas, at least several times with walking distance limit, appeared to be in disorder. Such disorderly appearance of parking spaces as existing now in urban areas dictates further subdivision of the road net and hampers a balanced urban development, as well as causing serious traffic congestion. This situation poses a serious problem requiring a solution as soon as possible.

Increasing the capacity of accommodating vehicles in a parking building is a first and basic approach to resolve the traffic problem, which is currently under intensive study and remains as a realistic technical problem under the concept of urban planning.

The over-riding significance of this present invention lies in insuring the smooth urban traffic flow by means of increasing vehicle accommodating capacity in parking buildings in the urban areas now growing in density.

SUMMARY OF THE INVENTION

The present invention consists of a parking garage building which comprises a plurality of stories. Each story has parking spaces marked thereon. The plurality of stores are divided into blocks of several stories each, an access ramp is connected to each story. A plurality of egress ramps are attached to the building. Each egress ramp ascends from ground to one of the blocks without access to any lower block. Each egress ramp has access to each story of its associated block. The ramps can be arranged in helical fashion on the outside of the building.

BRIEF DESCRIPTION OF THE DRAWINGS

In FIG. 4, a cross-line represents a floor of each story of the building and a slanted line represents a ramp.

DETAILED DESCRIPTION OF THE INVENTION

Figure 4:
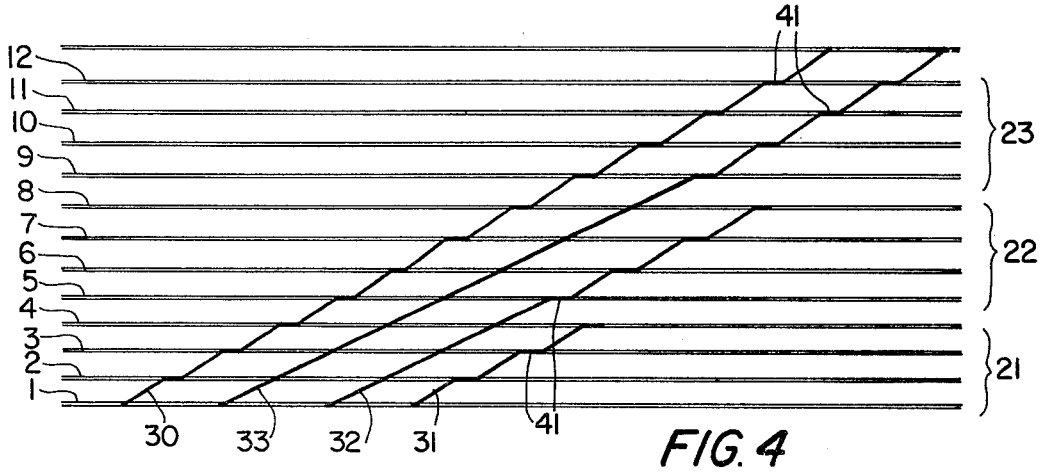
FIG. 4 is a lateral diagrammatic view of a building which shows the technical structure of the present invention.

As to the technical composition of this present invention, explanation is given below through FIG. 1, FIG. 2, and FIG. 4.

Figure 2:
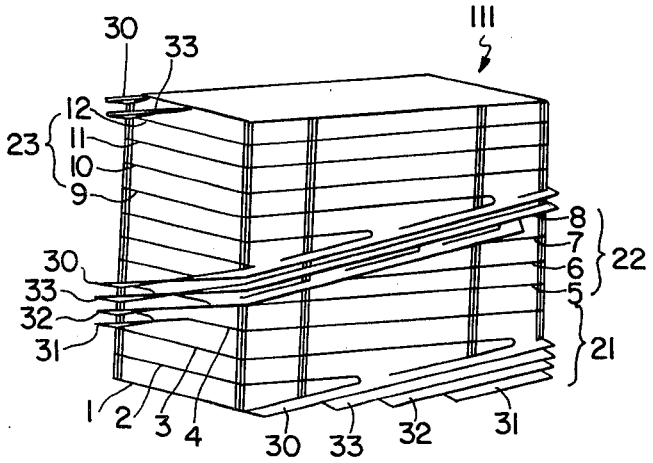
FIG. 2 is an elevation view of the embodiment shown in FIG. 1.
Figure 3:
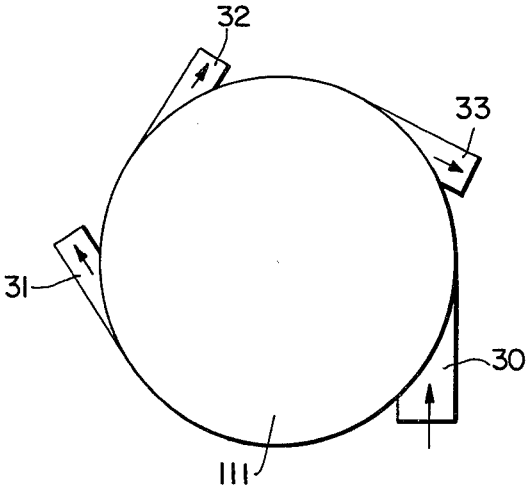
FIG. 3 is a planner view of a second embodiment.

FIG. 2 is a side view of the important part of the multi-exit parking garage under this present invention having its parking lots located on each of the stores (1), (2), (3), (4), (5), (6), (7), (8), (9), (10), (11), and (12). Also, there is an entrance connected with the up-ramp (30) and an exit (41) connected with each of the down-ramps (31), (32), and (33). Each of the stories (1), (2), (3), (3), (4), (5), (6), (7), (8), (9), (10), (11), and (12) of the building (111) is divided into blocks (21), (22), and (23), each of which is equipped with each of down ramps (31), (32), and (33).

In other words, the ramp (33) is a down ramp exclusively used by the block (23) and connected with the exits of the stories (9), (10), (11), and (12), comprising a non-stop passage from the 9th story to the ground floor. On the other hand, the ramp (32) is a down ramp exclusively used by the block (22) and connected with the exits of the stories (5), (6), (7), and (8), forming a non-stop passage to the ground floor from the 5th story. The ramp (31) is a down ramp exclusively used by the block (21) and connected with the exits of the stories (1), (2), (3), and (4), providing a downward passage exclusively from the 1st to the 4th story. Therefore, for an effective use of the parking building (111), it may be subdivided into a larger number of blocks to provide more down ramps (31), (32), (33), (34), (35).

Taking each story as an independent block, an independent down ramp may also be provided on each story.

Figure 1:
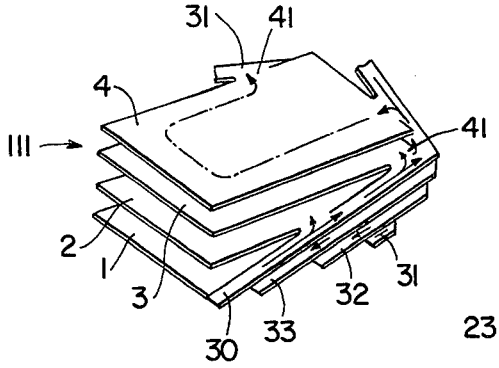
FIG. 1 is a diagrammatic view showing the general structure of one embodiment of the present invention.

The means of connecting the exit (41) of each of the stories (1), (2), (3), (4), (5), (6), (7), (8), (9), (10), (11), and (12) in the building (111) with the down ramp for each block, is, as shown in FIG. 1, to have each spirally winding down ramp cut in road width through the walls of the portion in contact with the surface of each story. That is, the parking building should be kept effectively used by making the exit of each story and the contacting surface of the ramp available for smooth flow of vehicles with proper slope and curves. The independent ramp (30) is for upward passage and is connected only with the entrance of each story as it wind up through each of the stories (1), (2), (3), (4), (5), (6), (7), (8), (9), (10), (11), and (12) of the building (111). In other words, the ramp (30) is a single-lane upward passage on which motor vehicles are diverted to each upper story through the entrance as they are driven upward. Also, as shown in FIG. 4, part of the up ramp (30) can be provided with a complementary ramp that directly connects an elevated highway or a steep hill according to geographic characters or peculiarities of urban structures. In the long run, the multi-exit parking garage under the present invention can be considered as a number of parking garages overlapped in a single high-rise building (111), having the blocks (21), (22), and (23) with an independent up and down ramps for each.

The characteristics of this present invention lies in improving the passage function of the parking building. That is, the up ramp (30) is connected in one way with the entrance of each story (1), (2), (3), (4), (5), (6), (7), (8), (9), (10), (11), and (12). But at the passageway (30), the entrance of each floor is in parallel to be a single one-way up passage but a number of vehicles can simultaneously enter in parallel from each story. Also, the ramps (31), (32), (33), etc., are connected in one way with the exit of each floor by block, comprising one-way plural passages downward. Thus, it is possible to drive out vehicles simultaneously from each story. That is, it is possible to drive in and out simultaneously from the parking building on a continuous basis. This way makes it possible to completely get rid of the past bottleneck caused by guardruple crossing, and when compared with the fact that the conventional parking buildings were not capable of driving in and out two or three cars on a continuous basis, the parking garage under this present invention is capable of driving in and out hundreds of vehicles on a continuous basis so long as parking space is available.

The other characteristics of this present invention are the maximum utilization of parking space and safe vehicle operation. These can be made possible through one multi-story spiralled winding up ramp (30) and down ramps (31), (32), (33) . . . installed outside the parking building (111).

In the case of the conventional parking garages, there was a great loss of parking space the up and down ramps were all installed on the same level within a building. But, the parking garage under this present invention is designed to maximize the utilization of parking space by building down ramps (31), (32), (33) . . . over one up ramp (30) which has an access to every floor.

This type of ramp structure has an advantage of expediting a maximum gyrating radius of passage and an angle of inclination that can be utilized on the basis of the building, and thus, even though with a fewer number of gyration of the building (111), safe operation of vehicles can be insured as the ramp can reach high-rise stories.

Frames comprising the multi-exit parking garage under this present invention are those of a building structure that consists of well-known ordinary reinforced steel concrete or steel beams. The parking garage under the present invention can readily serve its purpose without any specific technical difficulty by appropriately applying the gists of this present invention for designing in incorporation with the existing urban buildings. The parking building can also be equipped with such structures installed in ordinary buildings such as an elevator. Now, reference is to be made of the advantages in use of the parking building under the present invention, as explained above.

As explained the high rise building (111) is divided into appropriate blocks (21), (22), and (23) to permit maximum efficiency in a practical scale and each block (21), (22), and (23) is provided with an independent ramp (30), (31), and (33) to permit access to the ground. This the efficiency of vehicles entering and leaving increases in multiplicities like several varieties of a single parking building.

This increase of practical function varies with the number of blocks (21), (22), and (23) by dividing the parking (111) into several subdivisions. Yet, each block of (21), (22), and (23) is the same as a single parking building in practical capability. The blocks of the upper part in the parking building (111), for example, corresponding to block (22) or (23), require further driving and length of ramp in comparison with the blocks of the lower parts, for example, corresponding to block (21). The longer the length of the ramp, its functional loss is presumed accordingly. While the extended length of the ramp in the case of the block of the upper part compared with the lower portion blocks merely corresponds to a single extension of the lower end of the ramp connected to the building constituting each story of the block, passage through the extended portion is easy for a vehicle and, at the same time, any loss of parking function can be minimized.

However, as it is inevitable that parking in the block of the upper part is more troublesome than in the block of the lower part, it is considered that the upper block may be far more convenient for the vehicles that are required to stay a relatively longer period of time.

The ramps (30), (31), (32), and (33) that circle around the exterior of the parking building (111) command the largest radius and lowest slant degree as much as the building permits. Thus, numerical figures and values proper to the up and down passage on the ramp can be easily obtained.

In this respect, one complete round travel along the ramp of a conventional parking building is obviously distinguished from the climbing of one story of a building. In the conventional parking building, the ramp is connected with each story of the building in series but, in this present design, the connection is in a parallel pattern. Therefore, the function of parking and dispatching is increased and travel by vehicle on the ramp is very convenient.

The advantage stemming from the winding system of ramps around a bulding is that a primary cause of increasing parking accommodation is provided in that each story of the building is divided into proper and diverse numbers of ramps.

As pointed out previously, each block unit and corresponding up and down ramps are changeable, depending upon the density of vehicle travel along the ramps. This change is governed by maximum parking demand by time difference of coming into and out of the parking building and other considerations and factors in urban areas. Therefore, the function and ability of a parking building can be guaranteed to the maximum extent and economic factors of the parking building is fully improved.

The parking building under this present invention demonstrates an effect similar to plural parking buildings. Therefore, it is considered that this present invention, as explained in the foregoing, can effectively cope with the parking demand in the urban areas now growing in density, and can prevent an abnormal variety of cities resulting from the mushrooming of parking buildings in disorder. Therefore, the multi-exit parking garage under this present invention is worth presenting to urban planning experts for their consideration

We claim:

1. A parking garage building comprising a plurality of stories, each story having parking places marked thereon, said plurality of stories being divided into blocks of several stories each, an access ramp connected to each story, and a plurality of egress ramps attached to said building, each egress ramp ascending from ground to one of said blocks without access to any lower block, each egress ramp having access to each story of its associated block.

2. A parking garage according to claim 1 wherein said ramps are arranged in helical fashion on the outside of said building.

* * * * *